US010683780B2

(12) United States Patent
Moetakef

(10) Patent No.: US 10,683,780 B2
(45) Date of Patent: Jun. 16, 2020

(54) SYSTEM AND METHOD FOR A VARIABLE CAM TIMING PHASE CONTROL APPARATUS WITH ISOLATOR

(71) Applicant: Ford Global Technologies, LLC, Dearborn, MI (US)

(72) Inventor: Mohammad Ali Moetakef, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 351 days.

(21) Appl. No.: 15/667,552

(22) Filed: Aug. 2, 2017

(65) Prior Publication Data

US 2019/0040770 A1 Feb. 7, 2019

(51) Int. Cl.

| | |
|---|---|
| ***F01L 1/344*** | (2006.01) |
| ***F02D 41/00*** | (2006.01) |
| *F01L 1/053* | (2006.01) |
| *F02D 13/02* | (2006.01) |
| *F01L 1/047* | (2006.01) |

(52) U.S. Cl.

CPC ..... *F01L 1/3442* (2013.01); *F02D 41/00* (2013.01); *F01L 1/047* (2013.01); *F01L 2001/0535* (2013.01); *F01L 2001/0537* (2013.01); *F01L 2001/34453* (2013.01); *F01L 2001/34469* (2013.01); *F01L 2001/34496* (2013.01); *F01L 2250/02* (2013.01); *F01L 2250/04* (2013.01); *F01L 2250/06* (2013.01); *F01L 2800/00* (2013.01); *F01L 2800/01* (2013.01); *F01L 2800/03* (2013.01); *F01L 2810/00* (2013.01); *F02D 13/0215* (2013.01)

(58) Field of Classification Search

CPC ..... F01L 1/3442; F01L 1/047; F01L 2001/34453; F01L 1/46; F01L 2001/3445; F01L 2810/04

USPC ..... 123/90.17, 90.15, 90.16, 90.18

See application file for complete search history.

(56) References Cited

U.S. PATENT DOCUMENTS

| | | | | |
|---|---|---|---|---|
| 5,924,928 | A * | 7/1999 | Stegman | F16H 57/0006 464/73 |
| 5,931,052 | A | 8/1999 | Zhao et al. | |
| 6,840,202 | B2 | 1/2005 | Simpson | |
| 9,021,998 | B2 | 5/2015 | Moetakef et al. | |

(Continued)

FOREIGN PATENT DOCUMENTS

| | | | |
|---|---|---|---|
| JP | 2003314221 | A | 11/2003 |

*Primary Examiner* — Devon C Kramer
*Assistant Examiner* — Kelsey L Stanek
(74) *Attorney, Agent, or Firm* — Geoffrey Brumbaugh; McCoy Russell LLP

(57) ABSTRACT

Methods and systems are provided for a phase control apparatus in a variable cam timing (VCT) system of an engine, the phase control apparatus having a locked configuration where a locking pin coupled to a first vane of the vane rotor is engaged with a locking pin recess in a cover plate of the phase control apparatus. In one example, the phase control apparatus includes a rubber or plastic isolator pad positioned in a recess in a wall adjacent to the first vane such that when the vane rotor is rotated to the locked configuration, the first vane contacts the isolator pad before it can strike the housing. The isolator pad serves to maintain the gap between the first vane and the housing, and also reduces the likelihood of other vanes of the vane rotor from striking the housing.

19 Claims, 8 Drawing Sheets

(56) References Cited

U.S. PATENT DOCUMENTS

| | | | | |
|---|---|---|---|---|
| 2002/0043231 | A1* | 4/2002 | Hase | F01L 1/34<br>123/90.15 |
| 2003/0217720 | A1* | 11/2003 | Pierik | F01L 1/022<br>123/90.17 |
| 2013/0104820 | A1* | 5/2013 | Watanabe | F01L 1/3442<br>123/90.15 |
| 2016/0169059 | A1 | 6/2016 | Millen | |

* cited by examiner

SYSTEM AND METHOD FOR A VARIABLE CAM TIMING PHASE CONTROL APPARATUS WITH ISOLATOR

FIELD

The present description relates generally to methods and systems for a variable cam timing system including a locking phase control apparatus with an isolator to reduce knocking resulting from component contact.

BACKGROUND/SUMMARY

Variable cam timing (VCT) is used in engines to advance or retard intake and/or exhaust valve timing. Consequently, intake and/or exhaust valve timing may be adjusted based on engine operating conditions to increase combustion efficiency and decrease emissions, if desired. Additionally, engine power output may be increased across a wider range of engine operating conditions than with fixed valve timing systems.

A locking mechanism, also known as a phase control apparatus, of a VCT system may be configured to lock the VCT system in a desired base configuration when there is insufficient oil pressure to operate the VCT system, such as during engine startup, or during engine idle conditions. Specifically, the locking mechanism may include a locking pin that locks a rotor inside a housing of the phase control apparatus. Backlash and overtravel gaps between components of the locking mechanism, such as between the locking pin and its receiving hole in the housing, are carefully controlled to tight specifications. If backlash or overtravels gaps are too tight, sticking and binding issues may occur between locking components. Conversely, if backlash or overtravel gaps are too large, it may lead to noise, vibration, and harshness (NVH) issues during VCT operation. In some cases, camshaft torque fluctuations can cause the components of the locking mechanism to oscillate within the backlash gaps while in the locked configuration, thereby causing the components to impact each other and causing undesirable noise that may be referred to as knocking.

Other attempts to address NVH issues in VCT systems include methods for setting a locking pin backlash and/or overtravel gap for the locking mechanism that includes either adjusting the backlash during a VCT actuator assembly process or controlling it within tightly controlled tolerances. One example approach for a phase control apparatus is shown by Moetakef et al. in U.S. Pat. No. 9,021,998. Therein, a phase control apparatus is disclosed that includes a locking pin coupled to a vane of a rotor, the locking pin extending into a locking pin recess disposed in a cover plate in a locked configuration. There is locking pin backlash between the locking pin and locking pin recess, as well as VCT overtravel disposed between the vane and housing of the phase control apparatus in order to avoid impact between the vane of the rotor and the housing. Thus, in the locked configuration, a gap exists between the vane including the locking pin and the housing. However, the inventors herein have recognized potential issues with such systems. As one example, controlling the backlash and overtravel during assembly may involve precise measurement techniques that require frequent re-calibration, which may increase the time and cost of assembly. In another example, the backlash and overtravel tolerances may eventually degrade over time with normal wear of locking mechanism components, leading to an increase of NVH issues.

In one example, the issues described above may be addressed by a phase control apparatus for a camshaft including a vane rotor positioned within a housing and including a first vane extending from a central hub; a first chamber formed between walls of the housing and the hub, the first vane arranged within the first chamber; and an isolator pad positioned within a recess of a first wall of the walls and between the first wall and a first sidewall of the first vane. In this way, as the vane rotor is moved to a locked position it may contact the isolator pad, which may be constructed of a rubber or plastic material, without contacting the housing wall, thus reducing the likelihood of metal-to-metal contact. In this way, knocking noises due to metal components hitting one another may be mitigated without having to tightly control natural camshaft torque fluctuations and/or the tight tolerances of backlash and overtravel.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-7 are shown approximately to scale.

DETAILED DESCRIPTION

Figure 3:
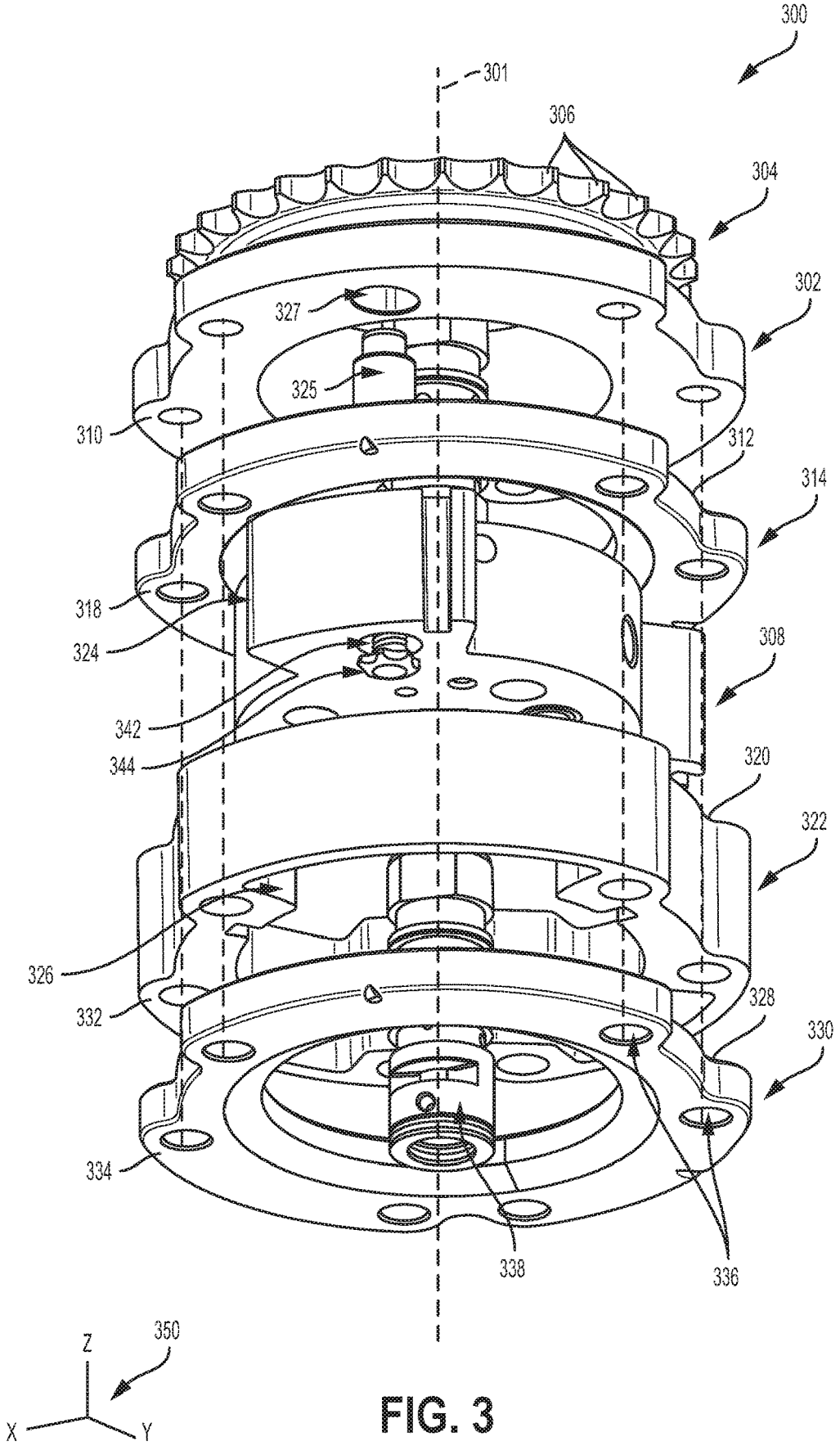
FIG. 3 shows an exploded view of an example phase control apparatus included in a VCT system.
Figure 4:
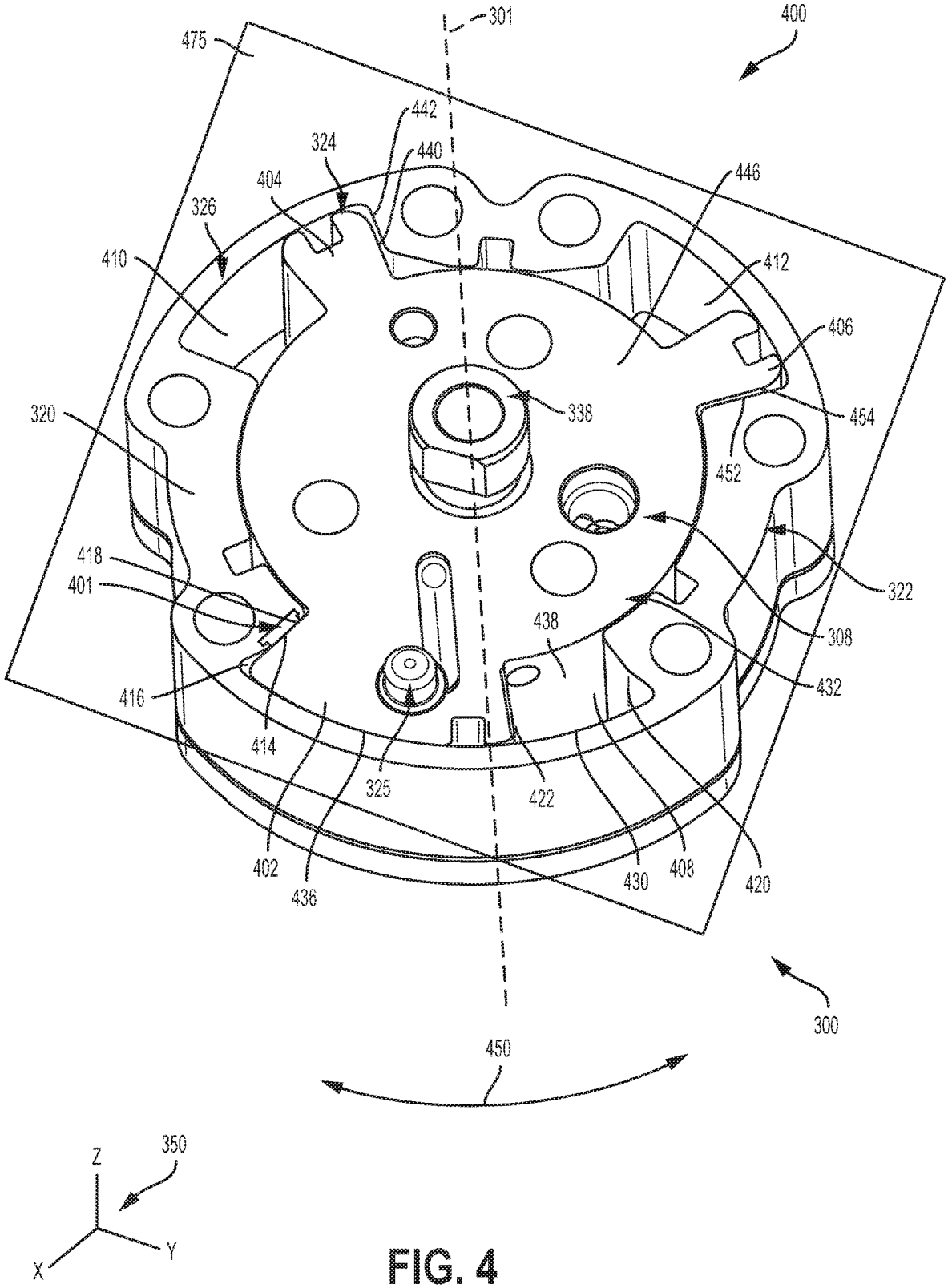
FIG. 4 shows the phase control apparatus of FIG. 3 in a locked configuration with a cover plate and an outer plate removed for clarity.
Figure 5:
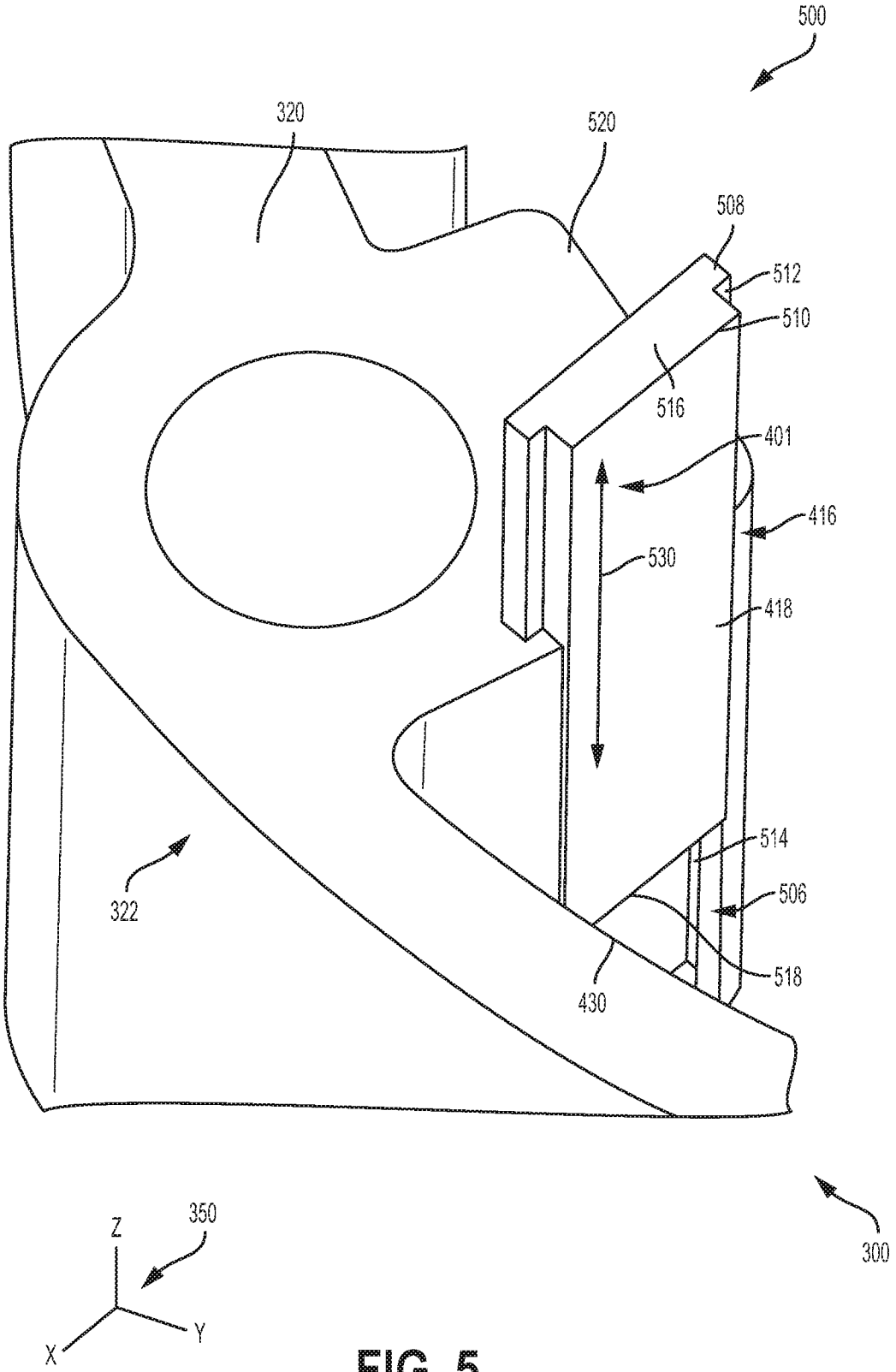
FIG. 5 shows a detailed view of an example isolator pad positioned within a recess of a housing included in the phase control apparatus of FIG. 3.
Figure 6:
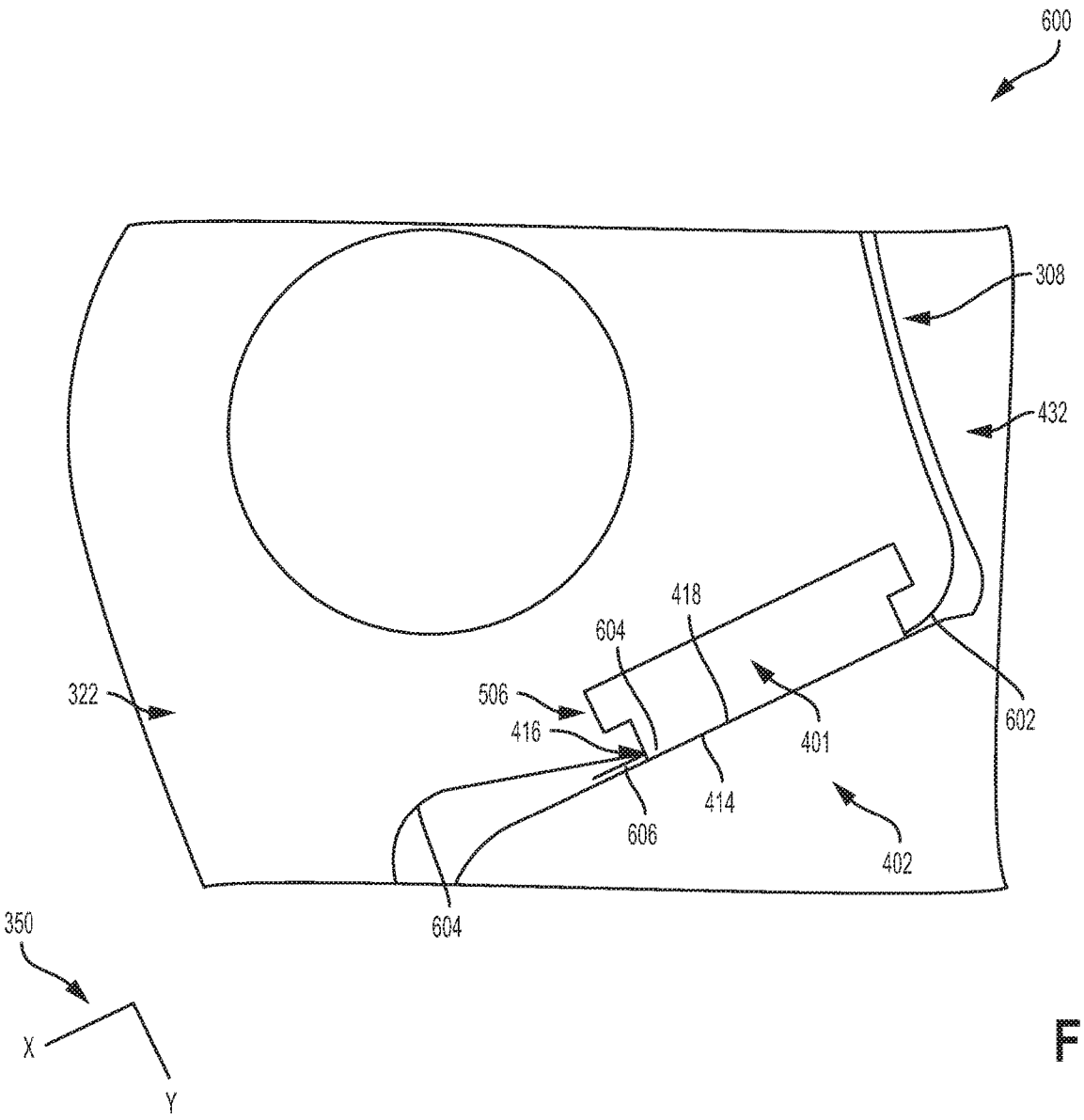
FIG. 6 shows a cross sectional detailed view of a first embodiment of a phase control apparatus in a locked configuration.
Figure 7:
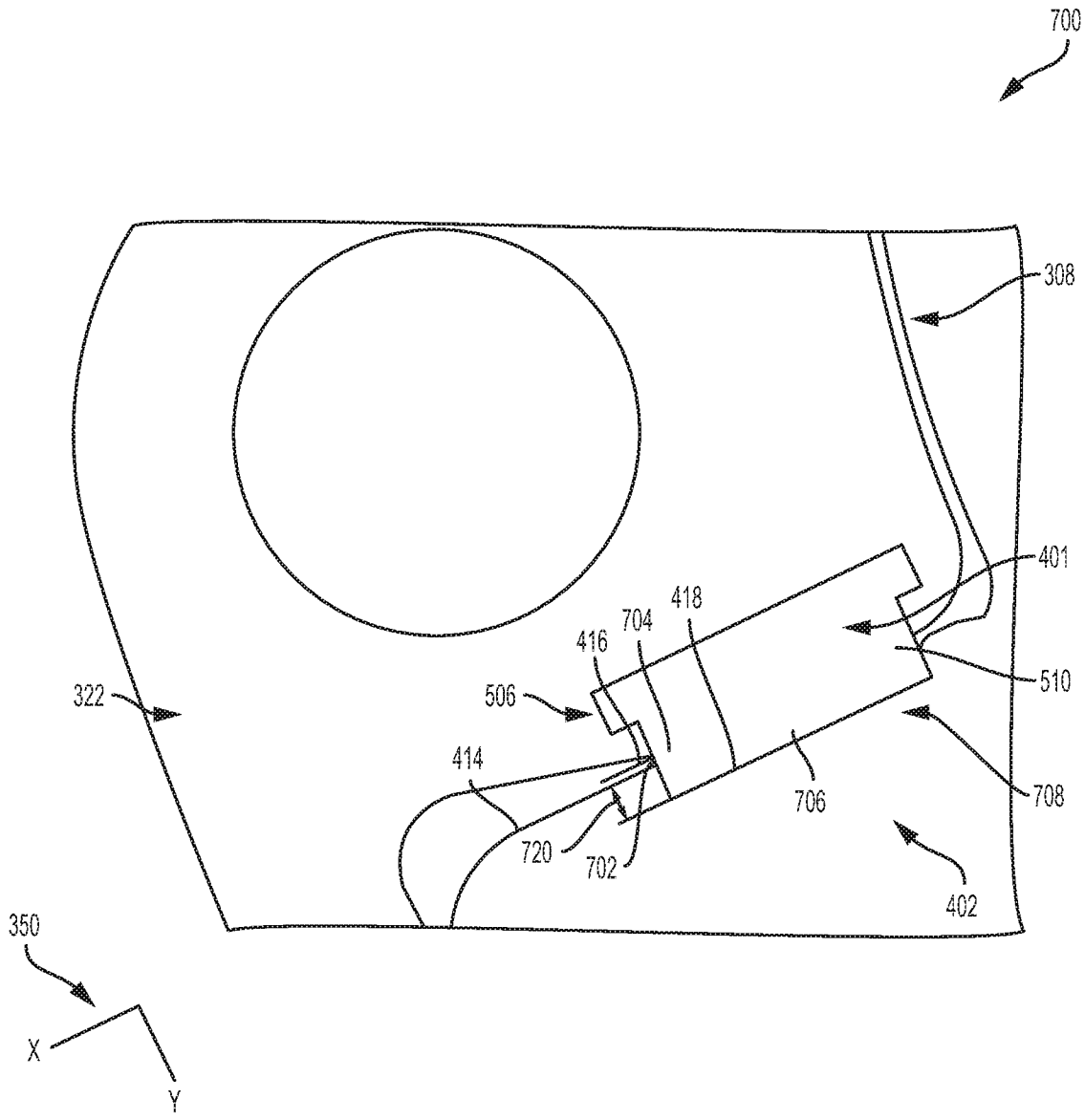
FIG. 7 shows a cross sectional detailed view of a second embodiment of a phase control apparatus in a locked configuration.
Figure 8:
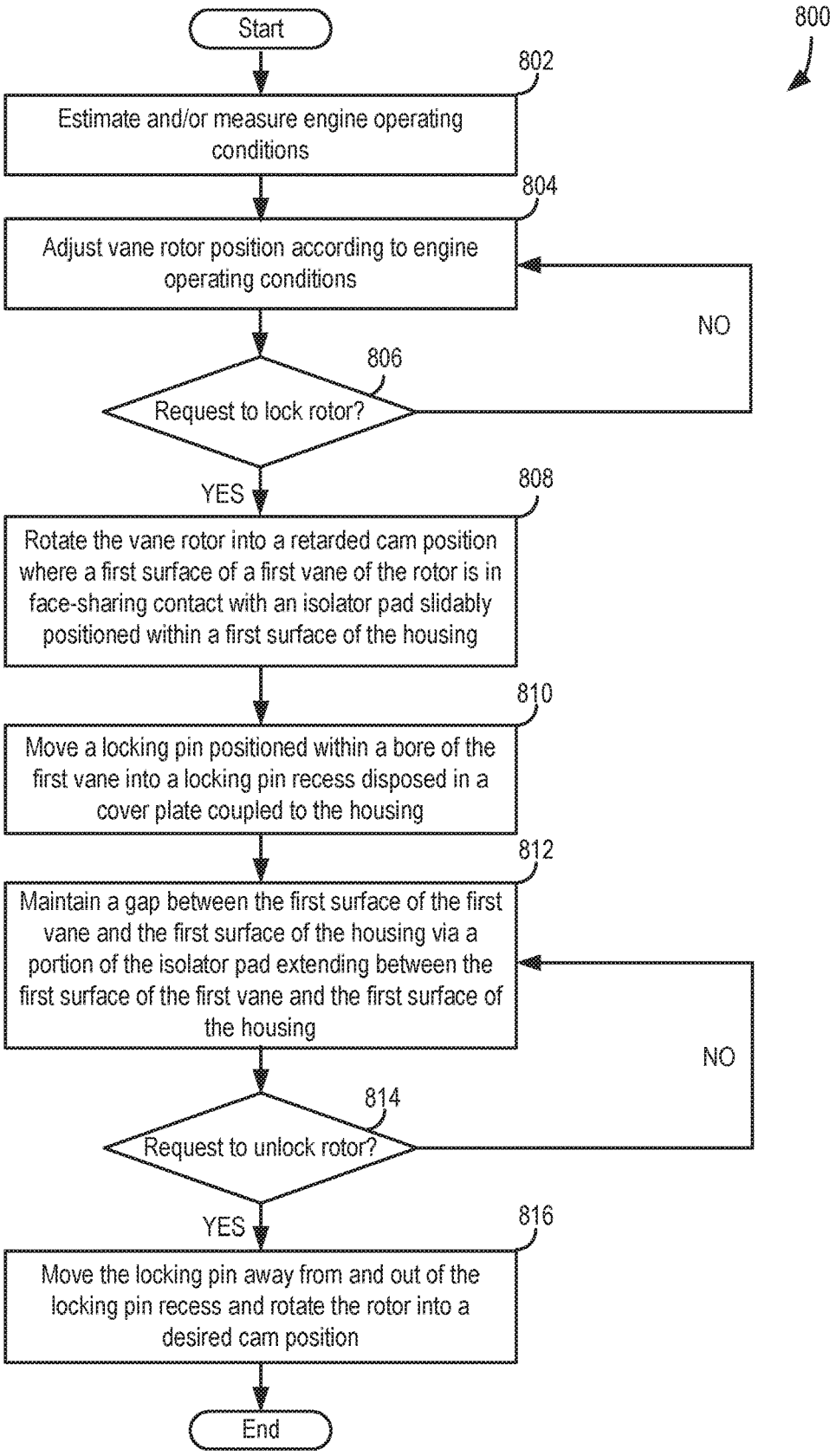
FIG. 8 shows a flow chart of a method for operating a phase control apparatus of a VCT system.

The following description relates to systems and methods for a variable cam timing (VCT) system including a locking phase control apparatus with an isolator pad. The engine shown in FIG. 1 includes a VCT system that may be configured to adjust the timing of both the intake valves and exhaust valves using a common camshaft, while the engine shown in FIG. 2 includes a VCT system that may be configured to adjust the timing of the intake valves using a first camshaft and adjust the timing of the exhaust valves using a second camshaft. VCT systems may include what is known as a phase control apparatus which may include a locking mechanism, such as the example embodiment shown in FIG. 3. The phase control apparatus may include a vane rotor positioned within a housing, as shown in FIG. 4, which is configured to rotate within the housing to adjust (e.g., advance or retard) the timing of the VCT system and to be locked from rotating with respect to the housing via a locking mechanism. During warm engine conditions, the vane rotor may be rotationally adjusted relative to the housing, thereby adjusting the valve timing responsive to operating conditions. During cold start and idle conditions, the vane rotor may be locked into a retarded timing position by engaging a locking pin coupled to a vane of the vane rotor into a locking pin recess located in a non-rotating cover plate of the phase control apparatus. During hot idle conditions, however, camshaft torque fluctuations can cause the rotor vane of the phase control apparatus to oscillate within a backlash (e.g., gap) between the locking pin and the locking pin recess. In order to prevent noise, vibration, and harshness (NVH) issues caused by the metal vane rotor striking the metal housing (e.g., knocking), an isolator pad is positioned along a wall of the housing, as shown in FIG. 4. The isolator pad may slide into a recess or channel in the wall of the housing, as shown in FIG. 5. The isolator pad may extend outward from the surface of the wall toward the vane such that a surface of the vane may be in face-sharing contact with a surface of the isolator pad when the vane rotor is locked against a cover plate coupled to the housing, rather than contacting the wall of the housing, as shown in FIG. 6. In this way, the likelihood of metal-to-metal contact between the vane and housing is reduced. In alternate embodiments, the vane may include a recess, or indentation, configured to receive the isolator pad when the vane rotor is locked against the cover plate coupled to the housing, as shown in FIG. 7. A method for operating the phase control apparatus of the VCT system, which includes locking and unlocking the apparatus, is shown at FIG. 8. By reducing the likelihood of metal-to-metal contact between the vane rotor and the housing, NVH issues may be reduced, along with customer complaints. Additionally, the longevity of the phase control apparatus may be extended.

Figure 1:
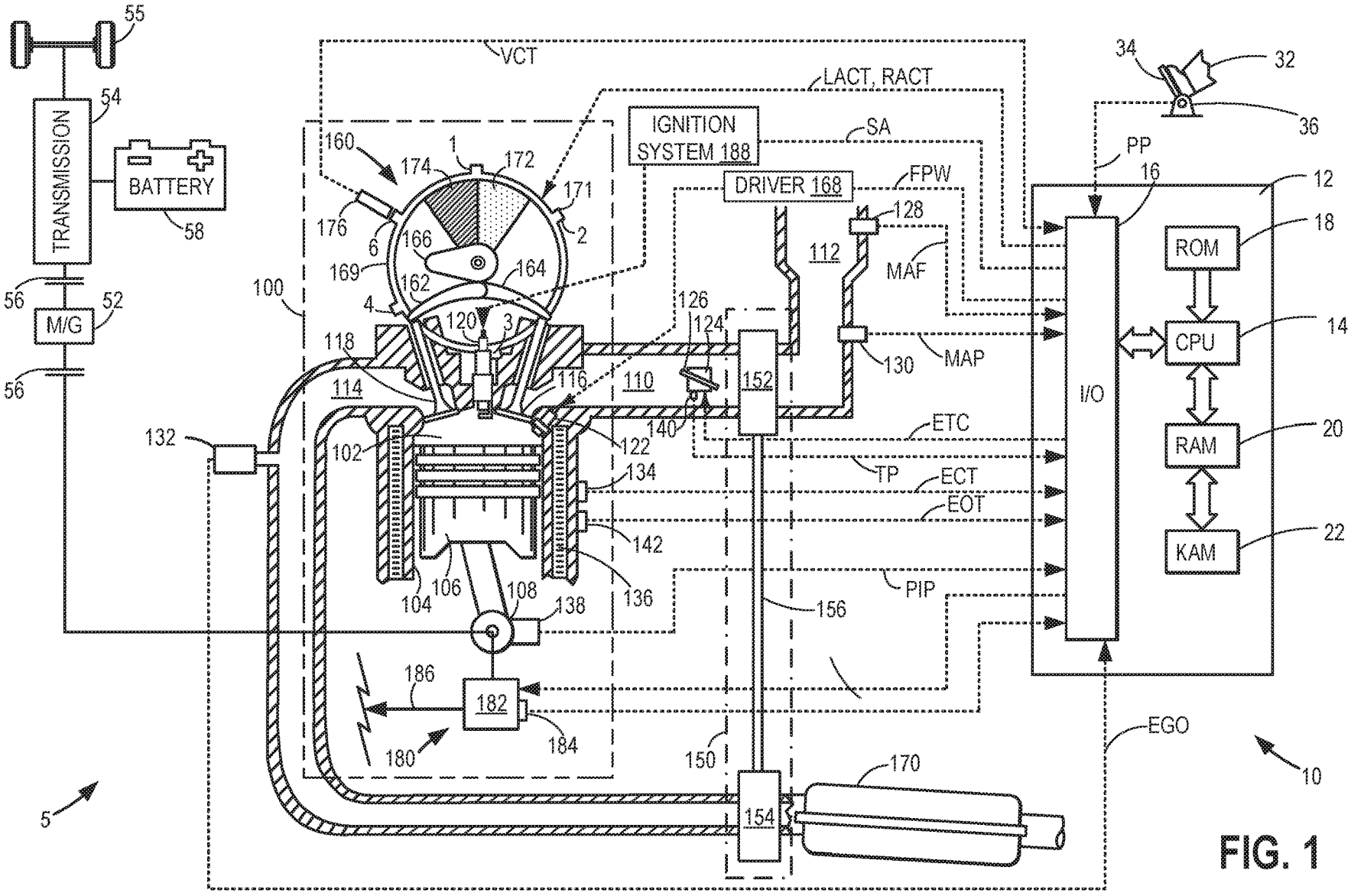
FIG. 1 shows a schematic depiction of an engine including a variable cam timing (VCT) system.

Turning now to FIG. 1, a schematic depiction of an engine 10 including a variable cam timing (VCT system) is shown. Engine 10 is included in vehicle 5. It will be appreciated that engine 10 may be any engine configuration. In one example engine 10 may be a V-8 engine with two cylinder banks, each having four cylinders. However in alternate examples, engine 10 may have an alternate configuration, such as an alternate number of cylinders (e.g., V-4, V-6, etc.), or an in-line arrangement of cylinders (e.g., I-3, I-4, etc.). As one non-limiting example, engine 10 can be included as part of a propulsion system for a passenger vehicle. Engine 10 may be controlled at least partially by a control system including controller 12 and by input from a vehicle operator 32 via an input device 34. In this example, input device 34 includes an accelerator pedal and a pedal position sensor 36 for generating a proportional, pedal position signal PP.

Engine 10 shows an example cylinder 102 (also known as combustion chamber 102) that is part of an engine block region 100 including a cylinder head and an engine block. The cylinder head may include one or more valves for selectively communicating with an intake and an exhaust system, for example, while the engine block may include multiple cylinders, a crankshaft, etc. It will be appreciated that block region 100 may include additional and/or alternative components than those illustrated in FIG. 1 without departing from the scope of this disclosure.

Cylinder 102 of engine 10 includes cylinder walls 104 with piston 106 positioned therein. Piston 106 is shown coupled to crankshaft 108 so that reciprocating motion of the piston is translated into rotational motion of the crankshaft. In some examples, vehicle 5 may be a hybrid vehicle with multiple sources of torque available to one or more vehicle wheels 55. In the example shown, vehicle 5 includes engine 10 and an electric machine 52. Electric machine 52 may be a motor or a motor/generator. Crankshaft 108 of engine 10 and electric machine 52 are connected via a transmission 54 to vehicle wheels 55 when one or more clutches 56 are engaged. In the depicted example, a first clutch 56 is provided between crankshaft 108 and electric machine 52, and a second clutch 56 is provided between electric machine 52 and transmission 54. Controller 12 may send a signal to an actuator of each clutch 56 to engage or disengage the clutch, so as to connect or disconnect crankshaft 108 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

In other examples, vehicle 5 is a conventional vehicle with only an engine, or an electric vehicle with only electric machine(s). In conventional vehicle examples, crankshaft 108 may be coupled to at least one drive wheel of a vehicle via an intermediate transmission system without an intermediate electric machine. Further, a conventional starter motor may be coupled to crankshaft 108 via a flywheel (not shown) to enable a starting operation of engine 10.

Cylinder 102 receives intake air from intake manifold 110 via intake passage 112 and exhausts combustion gases via exhaust passage 114. Intake manifold 110 and exhaust passage 114 can selectively communicate with cylinder 102 via respective intake valve 116 and exhaust valve 118. In some embodiments, cylinder 102 may include two or more intake valves and/or two or more exhaust valves. In some examples, engine 10 may be a variable displacement engine (VDE), having one or more cylinders 102 with selectively deactivatable intake valves 116 and selectively deactivatable exhaust valves 118.

In some embodiments, one or more of the intake passages may include a boosting device such as a turbocharger or a supercharger. For example, FIG. 1 shows engine 10 configured with a turbocharger 150 including a compressor 152 arranged between intake manifold 110 and intake passage 112, and an exhaust turbine 154 arranged along exhaust passage 114. Compressor 152 may be at least partially powered by exhaust turbine 154 via a shaft 156 where the boosting device is configured as a turbocharger. However, in other examples, such as where engine 10 is provided with a supercharger, exhaust turbine 154 may be optionally omitted, where compressor 152 may be powered by mechanical input from a motor or the engine 10.

In some embodiments, each cylinder of engine 10 may include a spark plug 120 for initiating combustion. Ignition system 188 can provide an ignition spark to combustion chamber 102 via spark plug 120 in response to spark advance signal SA from controller 12, under select operating modes. However, in some embodiments, spark plug 120 may be omitted, such as where engine 10 may initiate combustion by auto-ignition or by injection of fuel, as may be the case with some diesel engines.

Fuel injector 122 is shown coupled directly to combustion chamber 102 for injecting fuel directly therein in proportion to the pulse width of signal FPW received from controller 12 via electronic driver 168. In this manner, fuel injector 122 provides what is known as direct injection of fuel into cylinder 102. While FIG. 1 shows fuel injector 122 positioned to one side of cylinder 102, it may alternatively be located overhead of the piston, such as near the position of spark plug 120. Such a position may facilitate mixing and combustion when operating the engine with an alcohol-based fuel due to the lower volatility of some alcohol-based fuels. Alternatively, the injector may be located overhead and near the intake valve to increase mixing. Fuel may be delivered to fuel injector 122 by a fuel delivery system (not shown) including a fuel tank, a fuel pump, and a fuel rail. In some embodiments, combustion chamber 102 may alternatively or additionally include a fuel injector arranged in intake manifold 110 in a configuration that provides what is known as port injection of fuel into the intake port upstream of cylinder 102.

Intake manifold 110 is shown with throttle 124 including throttle plate 126 whose position controls airflow. In this particular example, the position of throttle plate 126 may be varied by controller 12 via a signal provided to an electric motor or actuator included with throttle 124, a configuration that may be referred to as electronic throttle control (ETC). In this manner, throttle 124 may be operated to vary the intake air provided to cylinder 102 along with other cylinders within engine 10. It will be appreciated that in alternate embodiments, throttle 124 may be positioned upstream of compressor 152, or there may be a first throttle positioned upstream of compressor 152 and downstream of compressor 152. Intake passage 112 may include a mass air flow (MAF) sensor 128 and a manifold absolute pressure (MAP) sensor 130 for providing respective signals MAF and MAP to controller 12.

Exhaust gas sensor 132 is shown coupled to exhaust passage 114 upstream of catalytic converter 170. Exhaust gas sensor 132 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 170 can include multiple catalyst bricks, in one example. In another example, multiple emission control devices, each with multiple bricks, can be used. Catalytic converter 170 can be a three-way type catalyst in one example. Engine 10 may further include one or more exhaust gas recirculation passages (not shown) for recirculating a portion of exhaust gas from the engine exhaust to the engine intake. As such, by recirculating some exhaust gas, an engine dilution may be affected which may be advantageous for engine performance by reducing engine knock, peak cylinder combustion temperatures and pressures, throttling losses, and NOx emissions.

Engine 10 includes an oil delivery system 180 for providing oil for component cooling and lubrication, as well as for oil pressure actuated (OPA) systems. The VCT system in the depicted embodiment is one non-limiting example of an OPA system. Oil delivery system 180 may include an oil pump 182 coupled to the engine and the VCT system that receives instructions from controller 12 to adjust oil output pressure and/or flow. In one example, oil pump 182 may be a variable displacement oil pump or a variable flow oil pump, including but not limited to an axial piston pump, a bent axis pump, or a variable displacement vane pump. In other examples, oil pump 182 may be a fixed rate oil pump with a regulator or actuatable valve to selectively control pump output, or another suitable type of oil pump with variable output. In another non-limiting example, oil delivery system 180 may include an active relief valve (not shown). Therein, oil pressure output may be increased or decreased as a result of actuation of the active relief valve. Further, the active relief valve may be controlled via a control solenoid that may be actuated by controller 12.

An oil pressure sensor 184 in oil delivery system 180 may be used to determine the oil pressure generated by the oil pump 182. In some examples, control of the oil pump may be feedback-based, wherein controller 12 receives a signal from oil pressure sensor 184 to adjust the operation of oil pump 182 to reach a desired oil pressure or to maintain a desired oil pressure. Oil pump 182 may be coupled to crankshaft 108 to provide rotary power for operating oil pump 182. In one example, oil pump 182 includes a plurality of internal rotors (not shown) that are eccentrically mounted. At least one of the internal rotors may be controlled by controller 12 to change the position of that rotor relative to one or more other rotors to adjust an output flow rate of oil pump 182 and thereby adjust the oil pressure. For example, the electronically controlled rotor may be coupled to a rack and pinion assembly that is adjusted via the controller 12 to change the position of the rotor. The oil pump 182 may selectively provide oil to various regions and/or components of engine 10 to provide cooling and lubrication, or to actuate movement of components. The output flow rate or oil pressure of the oil pump 182 may be adjusted by the controller 12 to accommodate varying operating conditions to provide varying levels of cooling and/or lubrication. Further, the oil pressure output from the oil pump 182 may be adjusted to reduce oil consumption and/or reduce energy consumption by the oil pump 182.

It will be appreciated that any suitable oil pump configuration may be implemented to vary the oil pressure and/or oil flow rate. In some embodiments, instead of being coupled to the crankshaft 108, oil pump 182 may be coupled to a camshaft, or may be powered by a different power source, such as a motor or the like. Oil pump 182 may include additional components not depicted in FIG. 1, such as a hydraulic regulator, electro-hydraulic solenoid valve, etc. (not shown).

Oil pumped by oil pump 182 may be routed through one or more channels 186 to components based on their oil flow and pressure demands. For example, oil may be pumped by oil pump 182 through a first channel of channels 186 to engine block region 100 to provide oil flow to a first group of components. In one example, the first group of components may include a variable camshaft timing (VCT) system 160. In other non-limiting examples, oil may be pumped by oil pump 182 via a second channel of channels 186 to a second group of components including, for example, turbocharger 150, bearings (not shown), and a piston cooling jet (not shown) in the engine block region 100. The second group of components may be grouped separately from the first group of components based on their higher pressure and lower oil flow demands for component cooling and lubrication. It will be appreciated that any number of engine components that utilize oil may be coupled to oil delivery system 180.

Cylinder head and engine block region 100 houses a variable valve operation system such as the VCT system 160. In this example, an overhead cam system is illustrated, although other approaches may be used. Specifically, camshaft 166 of engine 10 is shown communicating with rocker arms 162 and 164 for actuating intake valve 116 and exhaust valve 118, respectively. VCT system 160 may be oil-pressure actuated (OPA). By adjusting a plurality of hydraulic valves to thereby direct a hydraulic fluid, such as engine oil, into the cavity (such as an advance chamber or a retard chamber) of a phase control apparatus, valve timing may be changed (e.g., advanced or retarded). One non-limiting example of a phase control apparatus is shown in FIG. 3. The operation of the hydraulic control valves may be controlled by respective control solenoids. Specifically, an engine controller may transmit a signal to the solenoids to move a valve spool that regulates the flow of oil through the phaser cavity. As used herein, advance and retard of cam timing refer to relative cam timings, in that a fully advanced position may still provide a retarded intake valve opening with regard to top dead center, as an example.

Camshaft 166 is hydraulically coupled to housing 169. Housing 169 forms a toothed wheel having a plurality of teeth 171. In the example embodiment, housing 169 is mechanically coupled to crankshaft 108 via a timing chain or belt (not shown). Therefore, housing 169 and camshaft 166 rotate at a speed substantially equivalent to each other and synchronous to crankshaft 108. In an alternate embodiment, as in a four stroke engine, for example, housing 169 and crankshaft 108 may be mechanically coupled to camshaft 166 such that housing 169 and crankshaft 108 may synchronously rotate at a speed different than camshaft 166 (e.g. a 2:1 ratio, where the crankshaft rotates at twice the speed of the camshaft). In the alternate embodiment, teeth 171 may be mechanically coupled to camshaft 166.

By manipulation of the a vane rotor contained within housing 169 as described herein, the relative position of camshaft 166 to crankshaft 108 can be varied by hydraulic pressures in retard chamber 172 and advance chamber 174. For example, by allowing high pressure hydraulic fluid to enter retard chamber 172, the relative relationship between camshaft 166 and crankshaft 108 may be retarded. As a result, intake valve 116 and exhaust valve 118 may open and close at a time later than normal relative to crankshaft 108. Similarly, by allowing high pressure hydraulic fluid to enter advance chamber 174, the relative relationship between camshaft 166 and crankshaft 108 may be advanced. As a result, intake valve 116 and exhaust valve 118 may open and close at a time earlier than normal relative to crankshaft 108.

While this example shows a system in which the intake and exhaust valve timing are controlled concurrently, variable intake cam timing, variable exhaust cam timing, dual independent variable cam timing, dual equal variable cam timing, or other variable cam timing may be used. Further, variable valve lift may also be used. Further, camshaft profile switching may be used to provide different cam profiles under different operating conditions. Further still, the valve train may be roller finger follower, direct acting mechanical bucket, electrohydraulic, or other alternatives to rocker arms.

Continuing with VCT system 160, teeth 171, rotating synchronously with camshaft 166, allow for measurement of relative cam position via cam timing sensor 176 providing signal VCT to controller 12. Teeth 1, 2, 3, and 4 may be used for measurement of cam timing and are equally spaced (for example, in a V-8 dual bank engine, spaced 90 degrees apart from one another) while tooth 6 may be used for cylinder identification. In addition, controller 12 sends control signals (LACT, RACT) to conventional solenoid valves (not shown) to control the flow of high pressure hydraulic fluid either into retard chamber 172, advance chamber 174, or neither. In one embodiment, the high pressure hydraulic fluid may be the oil pumped by the oil pump 182.

Relative cam timing can be measured in a variety of ways. In general terms, the time, or rotation angle, between the rising edge of the PIP signal and receiving a signal from one of the plurality of teeth 171 on housing 169 gives a measure of the relative cam timing. For the particular example of a V-8 engine, with two cylinder banks and a five-toothed wheel, a measure of cam timing for a particular bank is received four times per revolution, with the extra signal used for cylinder identification.

As described above, FIG. 1 shows one cylinder of a multi-cylinder engine, and each cylinder may similarly include its own set of intake/exhaust valves, fuel injector, ignition system, etc.

Controller 12 is shown in FIG. 1 as a microcomputer, including microprocessor unit 14, input/output ports 16, an electronic storage medium with non-transitory memory for executable programs and calibration values, shown as read-only memory chip 18 in this particular example, random access memory 20, keep alive memory 22, and a data bus. Controller 12 is shown receiving various signals and information from sensors coupled to engine 10, in addition to those signals previously discussed, including measurement of inducted mass air flow (MAF) from mass air flow sensor 128; manifold absolute pressure (MAP) from MAP sensor 130; engine coolant temperature (ECT) from temperature sensor 134 coupled to cooling sleeve 136; a profile ignition pickup signal (PIP) from Hall effect sensor 138 (or other type) coupled to crankshaft 108; throttle position (TP) from a throttle position sensor 140. Further, controller 12 receives input regarding a temperature of engine oil (EOT) from an engine oil temperature sensor 142. Engine oil temperature sensor 142 may be mounted in engine block region 100. In some examples, engine oil temperature sensor may be mounted in the engine block or in the cylinder head.

The controller 12 may receive signals from the various sensors of FIG. 1 and employ the various actuators of FIG. 1 to adjust engine operation based on the received signals and instructions stored on a memory of the controller. For example, controller 12 may include memory with computer readable instructions for actuating the variable displacement oil pump to output oil at an upper threshold level in response to a command to advance the intake cam while engine speed is below a threshold speed and engine oil temperature is above a threshold temperature or a command to return the intake cam to a base (e.g., home) position that is a threshold amount of crank angle degrees away from a current position. Controller 12 may otherwise actuate the oil pump to output oil at a second level that is lower than the upper threshold level, the second level based on engine speed, engine load, and engine oil temperature.

In some examples, adjusting oil pump 182 may include adjusting an actuator of oil pump 182 to adjust the oil output of the oil pump. Adjusting an actuator of the oil pump may include the controller sending a signal, based on a first relationship between oil pressure, engine load, and engine speed and a second relationship between oil pressure, engine oil temperature, and engine speed, to the actuator of the oil pump in order to adjust the oil output of the oil pump.

Engine speed signal RPM is generated by controller 12 from signal PIP in a conventional manner and manifold absolute pressure signal MAP from manifold absolute pressure sensor 130 provides an indication of vacuum, or pressure, in the intake passage 112. During stoichiometric operation, one or more of the MAF and MAP sensors can be used to provide an indication of engine load. Use of the MAF and/or MAP sensors, along with engine speed, may provide an estimate of charge (including air) inducted into an engine cylinder, which may be used to determine engine load. In some examples, engine load may be a calculated load value (CLV) or an absolute load value (ALV). It will be appreciated that engine load may be characterized using a plurality of methods. One example method of quantifying engine load is the ratio of current airflow through an engine cylinder divided by the maximum possible airflow through that cylinder. This ratio may be 1 at wide-open-throttle. Boosted engines may be able to achieve an engine load greater than 1 as compressed air (e.g., air at a pressure greater than barometric pressure) is forced into the engine cylinders. Likewise, it will be appreciated that calibration of oil pump 182 may likewise use data regarding indications of engine load other than engine load based on MAF or MAP sensor indications. In one example, oil flow pressure from oil pump 182 may be adjusted responsive to an indication of engine torque, or to an indication of engine vacuum. Further, it will be appreciated that calibration of the oil pump 182 may use data regarding indications of engine temperature other than engine oil temperature. In one example, oil flow from oil pump 182 may be adjusted responsive to engine coolant temperature or another suitable temperature indication.

In one example, Hall effect sensor 138, which is also used as an engine speed sensor, produces a predetermined number of equally spaced pulses per revolution of the crankshaft. As will be described below, engine speed, engine load, and engine oil temperature measurements may be used to determine oil pump output.

As another example, adjusting the oil flow delivered to the VCT system 160 may include the controller 12 receiving an indication of VCT phaser position from cam timing sensor 176, an engine speed from Hall effect sensor 138, and an indication of engine oil temperature from engine oil temperature sensor 142. In one non-limiting example, responsive to those indications, including a request to move the VCT phase to a home position (e.g., locked position) from a position of more than a non-zero threshold distance away from the home position, the controller 12 may command an actuator of the oil pump 182 to increase output of the oil pump 182 in order to provide an increased amount of oil flow to the VCT system 160 and urge the vane rotor toward the home position.

Figure 2:
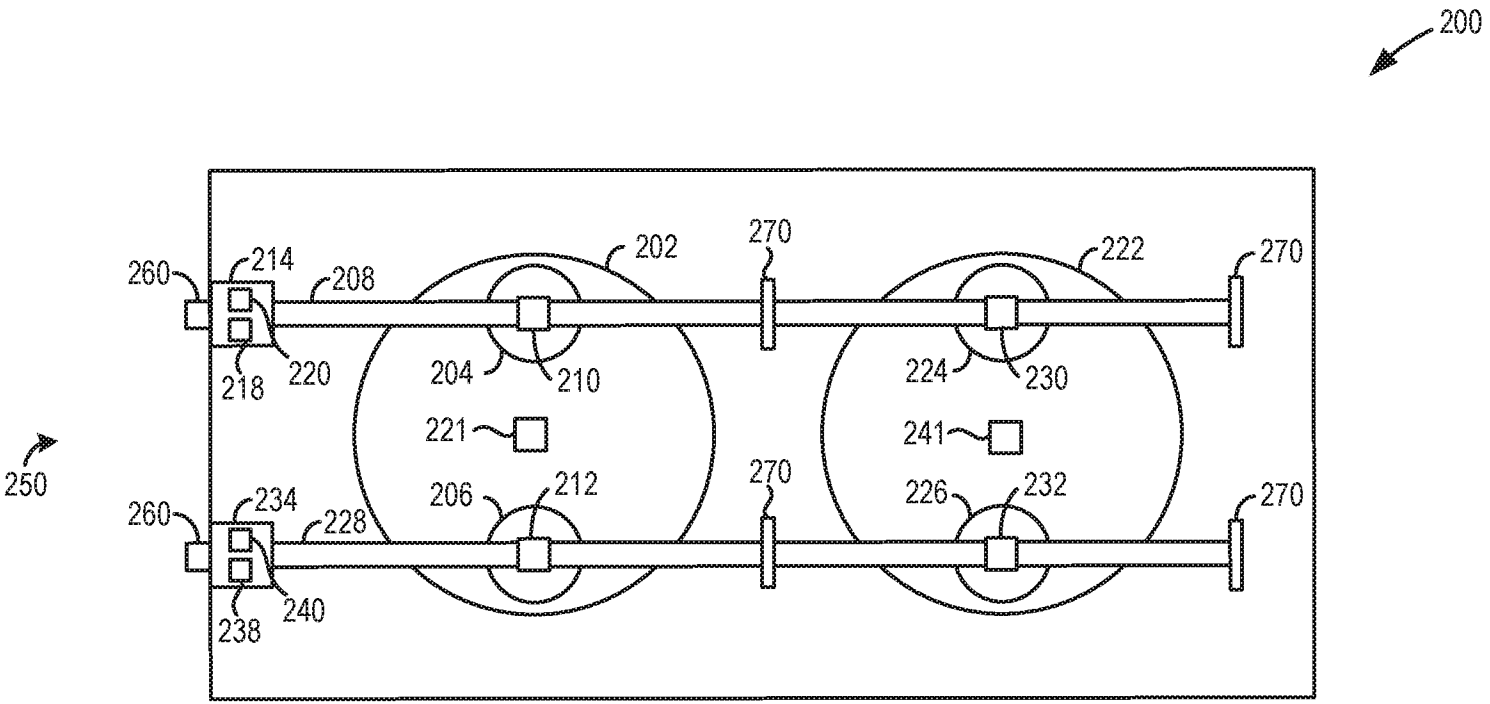
FIG. 2 shows another schematic depiction of a VCT system for an engine.

Turning now to FIG. 2, it shows an alternate schematic depiction of a variable cam timing (VCT) system 250 for an engine 200. It will be appreciated that engine 200 may be the same as engine 10 (shown in FIG. 1), but engine 200 may include a VCT system that is configured to adjust the timing of the intake valves using a first camshaft, while adjusting the timing of the exhaust valves using a second camshaft. It will be appreciated that in other examples, the VCT system may be configured to adjust the timing of the intake cams or the timing of the exhaust cams. Engine components of engine 200 not shown in FIG. 2 may be identical to those engine components of engine 10 shown in FIG. 1.

As shown, engine 200 includes the first cylinder 202 and a second cylinder 222. However, it will be appreciated that the number of cylinders in the engine may be varied in other examples. For instance, the engine 200 may include four cylinders, in one example.

The cylinders are arranged in an inline configuration. That is to say that a flat plane extends through the centerline of each cylinder. However, other cylinder positions have been contemplated. The intake valve 204 and the exhaust valve 206 of the first cylinder 202 are shown. It will be appreciated that the valve may be positioned, respectively, in an intake port and an exhaust port. Likewise, an intake valve 224 and an exhaust valve 226 are coupled to the second cylinder 222. The intake valve 224 and the exhaust valve 226 are configured to open during combustion operation. Specifically, the intake valve 224 may enable fluidic communication between the second cylinder 222 and the intake manifold 110, shown in FIG. 1, in an open configuration and inhibit fluidic communication between the second cylinder 222 and the intake manifold 110, shown in FIG. 1, in a closed configuration. Additionally, the exhaust valve 226 may enable fluidic communication between the second cylinder 222 and the exhaust passage 114, shown in FIG. 1, in an open configuration and inhibit fluidic communication between the second cylinder 222 and the exhaust passage 114, shown in FIG. 1, in a closed configuration.

The VCT system 250 may include an intake camshaft 208 and/or an exhaust camshaft 228. The intake camshaft 208 may include intake cam 210 and intake cam 230 coupled thereto. The intake cams 210 and 230 are configured to cyclically actuate the intake valves during combustion operation. Likewise, the exhaust camshaft 228 may include exhaust cam 212 and exhaust cam 232 coupled thereto. The exhaust cams 212 and 232 are configured to cyclically actuate the exhaust valves during combustion operation. It will be appreciated that the circumferential position of the intake and/or exhaust cams may vary to enable actuation of the intake and exhaust valves at different time intervals.

The VCT system 250 further includes a first phaser 214 (e.g., intake phase control apparatus) and a second phaser 234 (e.g., exhaust phase control apparatus). As shown, the first phaser 214 is coupled to the intake camshaft 208, and the second phaser 234 is coupled to the exhaust camshaft 228. The first and second phasers may be configured to adjust the phase between the crankshaft 108, shown in FIG. 1, and the respective camshaft. The first phaser 214 may be identical to the second phaser 234. However, in other examples the phasers (214 and 234) may have dissimilar configurations. The VCT system 250 may further include mechanical linkage 260 coupling the crankshaft 108, shown in FIG. 1, to the camshafts (208 and 228).

The first, intake phaser 214 may include a locking mechanism 218 generically depicted via a box. Likewise, the second, exhaust phaser 234 may also include a locking mechanism 238. The locking mechanisms (218 and 238) may be identical, in one example, or may have dissimilar configurations. In some examples, locking mechanism may include an actuatable pin that engages with a locking recess in order to lock a phaser in a home position. In some embodiments, the locking mechanism may include a vane rotor, such as the vane rotors described below in reference to FIGS. 3-4.

The controller 12 (shown in FIG. 1) may be configured to control the VCT system 250 to advance or retard intake and/or exhaust valve timing. Specifically, the controller 12 may be electronically (e.g., wired and/or wirelessly) coupled to control valves 220 and 240 (e.g., solenoid valves) in the VCT system 250. The control valves 220 and 240 may be coupled to or integrated into their respective phaser. The control valves 220 and 240 may be configured to adjust the phase between the crankshaft 108, shown in FIG. 1, and a corresponding camshaft. Specifically, the control valves 220 and 240 may be oil control valves configured to hydraulically adjust the phase angle between the crankshaft 108, shown in FIG. 1 and camshaft 208 or camshaft 228, respectively. Thus, the control valves 220 and 240 may receive oil from conduits in the engine. However, other suitable types of control valves have been contemplated.

Camshaft bearings 270 are coupled to the intake camshaft 208 and the exhaust camshaft 228. The camshaft bearings 270 are configured to support as well as enable rotation of the camshaft to which they are coupled. The spark plug 221 is also shown coupled to the first cylinder 202. A second spark plug 241 or other suitable ignition device may be coupled to the second cylinder 222.

As previously mentioned, the output of an oil pump, in one example, a variable displacement oil pump, may be actively controlled by a vehicle controller to meet the engine cooling, lubrication, and actuation demands of an engine for a given operating condition. Specifically, a controller, such as controller 12 of FIG. 1, may reference calibration data stored in its memory to adjust the output of an oil pump, such as oil pump 182 coupled to the engine. In one non-limiting example, adjustment of the oil pump output may be responsive to engine parameters such as engine oil temperature, engine load, and engine speed.

FIGS. 3-7 show an example phase control apparatus 300. For example, FIGS. 3-7 show different views and cross-sections of the phase control apparatus 300. The phase control apparatus 300 shown in FIGS. 3-7 may be the first or the second phase control apparatus (216 and 218 respectively), shown in FIG. 2. Thus, the phase control apparatus 300 may be included in one or more of the VCT system 160 shown in FIG. 1 and the VCT system 250 shown in FIG. 2. A coordinate system 350 is shown in FIGS. 3-7 to provide a reference orientation for each view. As described further below, the phase control apparatus 300 includes a vane rotor 308 positioned within a housing 322 and an isolator pad 401 arranged between a surface of the housing 322 and the vane rotor 308 to reduce contact (and thus noise) between the housing 322 and vane rotor 308 when the vane rotor 308 is locked within the housing 322. Additionally, FIG. 6 shows a first embodiment of an interface between the vane rotor 308 and isolator pad 401 while FIG. 7 shows a second embodiment of the interface between the vane rotor 308 and isolator pad 401.

Turning now to FIG. 3, it shows an exploded view of the phase control apparatus 300 that may be included in a variable cam timing (VCT) system, such as one of the VCT systems shown in FIGS. 1 and 2. Phase control apparatus 300 includes a cover plate 302 which may include, or be coupled to, a drive wheel 304. In the depicted example, the drive wheel 304 is a sprocket and therefore includes teeth 306 equally spaced and positioned 360 degrees around an outer circumference of the drive wheel. However, other types of drive wheels have been contemplated. The drive wheel 304 may be coupled (e.g., rotationally coupled) to a crankshaft of the engine, such as crankshaft 108 shown in FIG. 1 using a mechanical linkage (not shown) such as a chain, belt, or additional sprockets. Therefore, it will be appreciated that the drive wheel 304 and the crankshaft of the engine may rotate in the same phase. A rotational axis 301 of the phase control apparatus passes through the central axis of the phase control apparatus, which is also parallel with the z-axis shown in coordinate system 350.

An inner surface 310 of cover plate 302 may couple to an outer surface 312 of an outer plate 314. In one example, outer plate 314 may serve as a spacer mounted between a housing 322 and cover plate 302, such that an inner surface 318 of outer plate 314 couples to an outer surface 320 of housing 322. It will be appreciated that housing 322 may be similar to housing 169 described in FIG. 1. The housing 322 may be fixedly coupled to the cover plate 302 and drive wheel 304 via outer plate 314. Thus, the housing 322 and the drive wheel 304 rotate in the same phase. Vane rotor 308 is also shown, which may be fixedly coupled to a camshaft, such as one of the camshafts of FIG. 1 or 2. Therefore, it will be appreciated that vane rotor 308 and a camshaft of the engine may rotate in the same phase.

The housing 322 at least partially encloses the vane rotor 308 and, specifically, a plurality of vanes 324 of the vane rotor 308. When assembled, each vane of vanes 324 of the vane rotor 308 is positioned within a respective chamber of a plurality of chambers 326 of housing 322. Thus, the vane rotor 308 may be referred to as being positioned within the housing 322. The relative angular position (e.g., position about rotational axis 301) of the vane rotor 308 and the drive wheel 304 may be adjusted via manipulation of the phase control apparatus 300 of the VCT system. In this way, the phase of the cams may be adjusted to alter valve timing.

In the depicted example, a first vane of vanes 324 includes a locking pin 325 positioned within a bore 342 of the first vane that may be configured to move into and out of a locking pin recess 327 of the cover plate 302 to lock the phase control apparatus (e.g., lock rotation of the vane rotor relative to the housing). The locking pin may be configured with a biasing force (e.g., spring 344) that urges the pin toward the locking pin recess. This will be described in further detail below.

An outer surface 328 of an inner plate 330 may couple to an inner surface 332 of housing 322. The housing 322 holds an isolator pad within a recess, as will be described further below in reference to FIGS. 4-5. Fasteners (not shown) may be coupled through axially-aligned apertures 336 that pass through inner plate 330, housing 322, outer plate 314, and cover plate 302, as shown in FIG. 3. In one example, apertures 336 may be bolt holes configured to receive threaded bolts. In the depicted example, six apertures are shown, but it will be appreciated that more or fewer apertures may be used.

A spool valve 338 is configured to direct hydraulic fluid (e.g., oil) to certain portions of the phase control apparatus 300 for phase adjustment. In one example, the spool valve 338 may be centrally located (e.g., axially aligned with rotational axis 301), but in other examples it may be a remotely mounted spool valve. The spool valve 338 may be coupled to the camshaft and the vane rotor 308 to control cam timing by positioning the vane rotor 308 with respect to the housing 322 in an advanced or retarded position.

Turning now to FIG. 4, it shows a perspective view 400 of the phase control apparatus 300 introduced in FIG. 3 including the vane rotor 308 positioned within the housing 322, but with the cover plate 302 and outer plate 314 removed for clarity. Rotational axis 301 and coordinate system 350 are shown for reference. As previously described, vane rotor 308 may be fixedly coupled to a camshaft via hub (e.g., hub portion) 432 of the vane rotor 308. It will be noted that hub 432 may also include spool valve 338. The housing 322 at least partially encloses the vane rotor 308 and specifically, encloses the plurality of vanes 324 of the vane rotor 308 in a plurality of respective chambers 326 of the housing 322. When assembled as shown, the outer surface 320 of housing 322 may be in the same x-y plane (of coordinate system 350) as the outer surface 446 of vane rotor 308.

In the depicted example, the vane rotor 308 includes three vanes including a first vane 402, a second vane 404, and a third vane 406 extending radially outward from annular hub 432 of the vane rotor 308. However, an alternate number of vanes may be used. In one example, the vane rotor 308 may include a single vane. In other examples, the vane rotor 308 may include four or more vanes. Each vane 324 is housed within one of a plurality of hydraulic chambers 326 (also known simply as chambers) of the housing 322. Specifically, first vane 402 of vane rotor 308 is positioned within a first chamber 408 of housing 322, second vane 404 of vane rotor 308 is positioned within a second chamber 410 of housing 322, and third vane 406 of vane rotor 308 is positioned within a third chamber 412 of housing 322. In this way, the second vane 404 is separated from both the first vane 402 and the third vane and arranged within the second chamber 410 of the housing, which is spaced away from both the first chamber 408 and the third chamber 412. In some embodiments, both the vane rotor and the housing are constructed of a metal material, although other materials have been contemplated. The vane rotor and the housing may be made of an identical material, or may be constructed of different types of material.

First chamber (e.g., first hydraulic chamber) 408 is formed between a first wall 416 of the housing 322, a second wall 420 of the housing, a first inner circumferential wall 430 of the housing, and the hub 432 (e.g., an outer circumferential wall 438 of hub 432) of the vane rotor 308, where the first wall 416 is arranged opposite the second wall 420 in a direction of a circumference of the housing 322, and where the first inner circumferential wall 430 is coupled to each of the first wall 416 and second wall 420, and wherein only the first wall 416 includes a recess that includes an isolator pad, as described below. First inner circumferential wall 430 may be contacting, or in close proximity to, outer circumferential surface 436 of first vane 402. Additionally, no walls of the second chamber 410 or third chamber 412 include a recess with an isolator pad. Rotating the vane rotor 308 into the fully retarded position (which may also be a locked configuration when the locking pin is engaged with the locking pin recess) includes moving the first vane 402 of the vane rotor 308 toward the first wall 416 of the housing and into contact with the first surface 418 of the isolator pad 401. At the same time, rotating the vane rotor 308 into the fully retarded position includes moving the second vane 404 of the vane rotor 308 toward a surface 440 of the housing forming, in part, a second hydraulic chamber 410 that is spaced away from the first hydraulic chamber 408, and maintaining a gap 442 between the second vane 404 and the surface 440, and where the surface 440 does not include a recess with an isolator pad. Due to the presence of gap 442, even when the vane rotor is locked in the fully retarded position, there is no need for an isolator pad in the surface 440 of the second hydraulic chamber 410 of the housing. Similarly, rotating the vane rotor 308 into the fully retarded position includes moving the third vane 406 of the vane rotor 308 toward a surface 452 of the housing forming, in part, the third hydraulic chamber 412 that is spaced away from the first hydraulic chamber 408 and the second hydraulic chamber 410, and maintaining a gap 454 between the third vane 406 and the surface 452, and where the surface 452 does not include a recess with an isolator pad. Due to the presence of gap 454, even when the vane rotor is locked in the fully retarded position, there is no need for an isolator pad in the surface 452 of the third hydraulic chamber 412 of the housing.

The phase control apparatus 300 shown in FIG. 4 is depicted in a locked configuration, where rotation of the vane rotor 308 is locked (e.g., relatively fixed so that the cam timing does not change) relative to the housing 322. This includes when the locking pin 325 may be inserted into locking pin recess 327 of cover plate 302 (shown in FIG. 3, not shown in FIG. 4). As shown, only the first vane 402 includes the locking pin 325 adapted to lock rotation of the vane rotor 308 within the housing 322. In some examples, a first surface 414 of first vane 402 may be rotated toward or away from a first wall 416 of housing 322 in a circumferential direction 450 (e.g., in a direction of rotation of the vane rotor, around the rotational axis 301) while the locking pin 325 is inserted into the locking pin recess 327 of FIG. 3. Specifically, the vane may be rotated with respect to the housing from a position when the locking pin is contacting the locking pin recess on an advanced side of the locking pin recess to a retarded side of the locking pin recess or any position therebetween, as the pin moves within the backlash. In the depicted example, the first surface 414 of first vane 402 is in face-sharing contact with first surface 418 of an isolator pad 401. Specifically, the distance between first surface 414 of first vane 402 and first surface 418 of isolator pad 401 may be zero. In this way, the first vane 402 may contact the isolator pad 401 before the first vane 402 strikes the housing 322, and whether or not the locking pin is oscillating within the locking pin recess, the isolator pad may prevent the vane from striking the housing. In some embodiments, isolator pad 401 may be constructed of a rubber or plastic material. In this way, the first vane 402, which may be constructed of metal, may contact the isolator pad 401, before it strikes the housing 322, which may also be constructed of a metal material. As a result, the isolator pad 401 may serve to dampen the impact between components of the phase control apparatus 300 as it is moved to the locked configuration, thereby reducing component wear, as well as reducing issues with NVH such as knocking. Further detail regarding the form and function of the isolator pad 401 will be described below and in reference to FIGS. 5-7.

On the other hand, when the phase control apparatus 300 is in an unlocked configuration, the relative position of the vanes 324 and the housing 322 may be adjusted via a control valve such as one of the control valves 220 and 240, shown in FIG. 2. Specifically, the first surface 414 of first vane 402 may be rotated away (e.g., rotated away in a circumferential direction) from first wall 416 of housing 322, increasing the distance between first surface 414 of first vane 402 and first surface 418 of isolator pad 401. At the same time, a distance between the second surface 422 of the first vane 402 and second wall 420 of housing 322 may decrease. In this way, the cam timing may be adjusted based on engine operating conditions. The controller 12, shown in FIG. 1, may be configured to send control signals to the control valve to trigger a cam timing adjustment and therefore is electronically coupled to the control valve.

As shown, the first surface 418 of isolator pad 401 may be correspondingly contoured to first surface 414 of first vane 402 such that the full first surface 418 of isolator pad 401 may contact a portion of first surface 414 of first vane 402. Specifically, the first surfaces 414 and 418 are planar in the depicted example and therefore may be referred to as planar surfaces. However, other surface contours have been contemplated, as will be described below in reference to FIG. 7.

The first surface 418 of the isolator pad 401 may correspond to a retarded cam timing position (e.g., fully retarded cam timing position). Therefore, when first surface 414 is in face-sharing contact with first surface 418, the phase control apparatus 300 may be in a retarded (e.g., fully retarded) cam timing position. Likewise, a second wall 420 of the housing 322 may correspond to an advanced cam timing position. Thus, when the second wall 420 of the housing 322 is in face-sharing contact with a second surface 422 of the first vane 402 the phase control apparatus 300 may be in an advanced cam timing position (e.g., fully advanced cam timing position). In this way, the housing 322 may define the advanced and retarded valve timing boundaries of the phase control apparatus 300. The cutting plane 475 defining the cross sectional views shown in FIGS. 6-7 is also illustrated in FIG. 4.

Turning now to FIG. 5, a detailed view 500 of the phase control apparatus 300 is shown that includes the housing 322 and isolator pad 401. The isolator pad 401 includes a first end 508 positioned entirely within the isolator pad recess 506 and a second end 510 extending outward from the first end 508 and protruding outward from the first wall 416 of the housing 322. As shown in the depicted embodiment, the first end 508 is wider than the second end 510. It will be appreciated that a transition surface 512 between the first end and second end may include a step as shown, or may be a chamfered or curved transition. The transition surface 512 is configured to fit complementarily with a corresponding retaining surface 514 of the isolator pad recess 506. In this way, the isolator pad 401 may be adapted to slide within the isolator pad recess 506 in a direction 530, parallel with the direction of the rotational axis (e.g., rotational axis 301 of FIG. 3, parallel with the z-axis of coordinate system 350), but once assembled, the inner plate (e.g., inner plate 330 of FIG. 3) and outer plate (e.g., outer plate 314 of FIG. 3) hold the isolator pad within the isolator pad recess, on either end of the housing 322. As a result of the isolator pad 401 being captured within the recess when assembled, the isolator pad stays positioned as desired without necessitating a complicated or costly fastening method. In other words, the isolator pad 401 is held within the isolator pad recess 506 with the outer plate coupled to a first, outer surface of the housing and an inner plate coupled to a second, outer surface of the housing and wherein the rotor is positioned within the housing, between the outer plate and inner plate.

The isolator pad 401 may extend along an entire length of the housing, the length defined in a direction of a rotational axis of the vane rotor (parallel with the z-axis of coordinate system 350). In this way, an outer surface 516 of the isolator pad 401 may be in the same plane as the outer surface 320 of housing 322 when assembled. Similarly, an inner surface 518 of isolator pad 401 may be in the same plane as the inner surface 332 of housing 322 (shown in FIG. 3) when assembled. Further, the isolator pad 401 may extend along only a portion of width of the first wall, the width defined between a first inner circumferential wall 430 of the housing 322 arranged proximate an outer circumferential surface of the first vane (e.g., outer circumferential surface 436 of FIG. 4) and a second inner circumferential wall 438 of the housing 322 arranged closer to the hub (e.g., hub 432 of FIG. 4) of the vane rotor (e.g., vane rotor 308 of FIG. 3-4) than the first inner circumferential wall.

The second end 510 of the isolator pad 401 may include a planar first surface 418 adapted to have face-sharing contact with a planar surface of the first sidewall (e.g., first surface 414 of FIG. 4) of the first vane 402 when the vane rotor is locked against a cover plate (e.g., cover plate 302 of FIG. 3) coupled to the housing 322 as previously described.

Turning now to FIG. 6, it shows a cross sectional detailed view 600, taken at cutting plane 475 of FIG. 4, of a first embodiment of a phase control apparatus in a locked (e.g., fully retarded) configuration. The phase control apparatus shown in view 600 may be similar to phase control apparatus 300 of FIGS. 3-5. As such, like components previously introduced in FIGS. 3-5 are numbered similarly in FIG. 6 and not reintroduced. As previously described, the locked configuration includes the vane rotor 308 locked against a cover plate (e.g., cover plate 302 of FIG. 3) coupled to the housing 322 via a locking pin (e.g., locking pin 325 of FIGS. 3-4) extending through the first vane 402 of vane rotor 308. Coordinate system 350 is also shown for reference. View 600 shows the isolator pad 401 positioned within the isolator pad recess 506, with first surface 418 in face-sharing contact with first surface 414 of first vane 402. The first surface 418 is planar and the first surface 414 is planar. Thus, as shown in view 600, the first surface 418 and first surface 414 are flush with one another. In the depicted view, a gap 606 exists between the first surface 414 of the first vane 402 and the first surface (e.g., first wall) 416 of the housing 322 via a portion 604 of the isolator pad 401 extending between the first surface 414 of the first vane 402 and the first surface (e.g. first wall) 416 of the housing 322. In this way, the first sidewall (e.g., first surface 414) of the first vane and the first wall 416 of the housing 322 are separated from one another via a gap 606, the isolator pad 401 extending between the first wall and first sidewall, across the gap. As a result, the first vane 402 of the vane rotor 308 is prevented from striking the first wall 416 of the housing 322 because the first vane contacts the isolator pad 401 before it can contact the housing 322.

The first wall 416 of the housing 322 includes a planar, first section 602 arranged adjacent to an angled, second section 604 depressed inward, into the housing 322, from the first section, wherein the first section is positioned closer to the hub 432 than the second section and wherein only the first section includes the isolator pad recess 506 (also known as recess 506). In some examples, second section 604 may be depressed inward in order to provide an avenue for hydraulic fluid. In other examples, second section 604 may be depressed inward in order to increase assurance that the first vane 402 may contact the isolator pad 401 and not the second section 604 of the housing.

Turning now to FIG. 7, it shows a cross sectional detailed view 700 of a second embodiment of a phase control apparatus in a locked configuration similar to the configuration of FIG. 6. The phase control apparatus shown in view 700 may be similar to phase control apparatus 300 of FIGS. 3-5. As such, like components previously introduced in FIGS. 3-5 are numbered similarly in FIG. 7 and not reintroduced. As described above, the cross sectional view is taken at cutting plane 475, as shown in FIG. 4, and coordinate system 350 is also shown for reference. View 700 shows the isolator pad 401 positioned within the isolator pad recess 506 with first surface 418 in face-sharing contact with a planar surface 706 of first vane 402. In the depicted view, a gap 702 exists between a first surface 414 of the first vane 402 and the first surface (e.g., first wall) 416 of the housing 322 via a portion 704 of the isolator pad 401 extending between the first surface 414 of the first vane 402 and the first surface (e.g., first wall) 416 of the housing 322. In this way, the first sidewall of the first vane and the first wall of the housing are separated from one another via gap 702, the isolator pad 401 extending between the first wall and first sidewall, across the gap 702. As a result, the first vane of the vane rotor is prevented from striking the first surface of the housing because the first vane contacts the isolator pad before it can contact the housing.

In the embodiment shown, the planar surface 706 of the first sidewall (e.g., first surface 414) is arranged within an indentation 708 that protrudes into the first vane a depth 720 from an outer surface of the first sidewall, and wherein the second end 510 of the isolator pad 401 is adapted to extend into the indentation 708, at a distance of the depth 720, and have face-sharing contact with the planar surface 706 of the first sidewall (e.g., first surface 414) of the first vane 402. In this way, first surface 418 of isolator pad 401 may be in face-sharing contact with planar surface 706 when the phase control apparatus is in the locked (e.g., fully retarded) configuration.

FIGS. 3-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Turning now to FIG. 8, it shows a flow chart of an example method 800 for operating a phase control apparatus of a VCT system. Instructions for carrying out method 800 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below. In one example, the method for operating the variable cam timing (VCT) system may include: in response to a request to lock rotation of a rotor within a housing of a drive wheel of the VCT system, rotating the rotor into a retarded cam position where a first surface of a first vane of the rotor is in face-sharing contact with an isolator pad slidably positioned within a first recess within a first surface of the housing, wherein the first vane is positioned in a first hydraulic chamber of the housing formed, in part, by the first surface of the housing; and moving a locking pin into a locking pin recess disposed in a cover plate coupled to the housing, the locking pin extending from the first vane.

Method 800 begins at 802, where the method includes estimating and/or measuring engine operating conditions. In one example, the engine operating conditions may include engine speed, pedal position, operator torque demand, an engine key-off signal, ambient conditions (ambient temperature, pressure, humidity), engine temperature, manifold air pressure (MAP), manifold air flow (MAF), oil pressure, etc. In other examples, estimating and/or measuring engine operating conditions may include a vehicle controller, such as the example controller 12 shown in FIG. 1, receiving various signals from sensors coupled to the engine. Example signals include signals indicating quantity of inducted mass air flow from a MAF sensor, engine coolant temperature from a temperature sensor, a profile ignition pickup signal (PIP) from a Hall effect sensor coupled to the crankshaft, a throttle position from a throttle position sensor, and an absolute manifold pressure signal from a MAP sensor. Engine speed signal and RPM may be generated by the controller from the PIP signal. Note that various combinations of the above sensors may be used, such as a MAF sensor without a MAP sensor, or vice versa.

In this way, engine operating conditions may be defined in order to, at 804, adjust vane rotor position according to the current engine operating conditions. As an example, the controller may actuate a control valve, such as one of the example control valves 220 and 240 shown in FIG. 2, to direct oil received from conduits in the engine to a hydraulic chamber within a housing of the phase control apparatus to hydraulically move the vane rotor of the phase control apparatus (coupled to a camshaft) and adjust the phase angle between the crankshaft and the respective camshaft. This adjustment of the phase angle between the crankshaft and a respective camshaft may advance the valve timing, if the rotor of the vane of the phase control apparatus is moved in an advanced direction. Alternately, the adjustment of the phase angle between the crankshaft and a respective camshaft may retard the valve timing if the rotor of the vane of the phase control apparatus is moved in a retarded direction. In one example, the controller may receive a signal from a pedal position sensor indicating that the operator has requested an increase in torque demand by actuating the accelerator pedal (e.g., tip in). Therein, the controller may, based on predetermined mapped data (stored in a memory of the controller) and additional sensor input, actuate a control valve to allow hydraulic fluid to enter the retarded side of the chamber. If the hydraulic fluid on the retarded side of the hydraulic chamber increases to a level greater than the hydraulic fluid on the advanced side of the chamber, the vane may be actuated by the pressure differential to move toward the advanced side of the chamber, thereby advancing the camshaft timing. In another example, the controller may receive a signal from a pedal position sensor indicating that the operator has a very low torque demand as indicated by a decrease in actuation of the accelerator pedal (e.g., cruising). Therein, the controller may, based on predetermined mapped data and additional sensor input, actuate a control valve to allow hydraulic fluid to enter the advanced side of the hydraulic chamber. If the hydraulic fluid on the advanced side of the hydraulic chamber increases to a level greater than the hydraulic fluid on the retarded side of the chamber, the vane may be actuated by the pressure differential to move toward the retarded side of the chamber, thereby retarding the camshaft timing.

At 806, the method includes determining whether the controller has received a request to lock the rotor (e.g., vane rotor of the phase control apparatus). In one example, a request to lock the vane rotor may be received when the engine is shut down. In another example, a request to lock the vane rotor may be received at an engine cold start (e.g., upon engine startup when engine temperature is below a threshold temperature) or an engine idle condition. As discussed previously, a locked position is the position where the locking pin (e.g., locking pin 325 of FIGS. 3-4) of the first vane (e.g., first vane 402 of FIGS. 4, 6-7) of the vane rotor is extended from the first vane and positioned in the locking pin recess (e.g., locking pin recess 327 of FIG. 3) disposed within the cover plate (e.g., cover plate 302 of FIG. 3) of the phase control apparatus. This may be known as a passive condition, where the relative positions of the rotor and the housing are constrained from rotating with respect to one another any distance greater than the amount of the backlash gap. Conditions such as engine shut down, cold start, and idle are all operating conditions when a passive, locked configuration of the phase control apparatus occurs. The request may include the controller receiving signals from the plurality of engine sensors previously mentioned to lock the vane rotor. If no request to lock the vane rotor is received at 806, then the routine continues adjusting vane rotor position according to engine operating conditions at 804.

If a request to lock the rotor is received, then at 808, the method includes rotating the vane rotor into a retarded cam position wherein a first surface of a first vane (e.g., first surface 414 of first vane 402 of FIG. 4) of the vane rotor moves into face-sharing contact with a first surface 418 of isolator pad 401 positioned within recess of the housing. In one example, the vanes of the vane rotor are positioned within hydraulic chambers of the housing and rotated into the retarded position by hydraulic actuation. For example, the controller may actuate a control valve of the phase control apparatus to allow hydraulic fluid to enter the advanced side of the hydraulic chamber. As the hydraulic fluid on the advanced side of the hydraulic chamber increases to a level greater than the hydraulic fluid on the retarded side of the chamber, the vane is actuated by the pressure differential to move toward the retarded side of the chamber, thereby retarding the camshaft timing. When a request to lock the rotor is received, the controller may actuate the control valve to increase the retarding (e.g., fully retard) the vane rotor, thereby rotating the rotor until the first surface (e.g. retarded side surface) of the vane comes into face-sharing contact with an isolator pad positioned within the first wall (e.g., retarded side wall) of the housing, without allowing the vane to directly contact the first wall of the housing.

At 810, the method includes moving a locking pin (e.g. locking pin 325 of FIGS. 3-4) positioned within a bore (e.g., bore 342 of FIG. 3) of the first vane into a locking pin recess disposed in a cover plate coupled to the housing. The locking pin is movable into a locked position where the locking pin engages the locking pin recess (e.g., locking pin recess 327 of FIG. 3), wherein in the locked position a retarded side (e.g., first surface 414 of FIGS. 4-7) of the first vane is in face-sharing contact with the isolator pad and separated from the first sidewall (e.g., first wall 416 of FIG. 4) of the housing via a gap (e.g., gap 606 of FIG. 6, gap 702 of FIG. 7). Therein, the isolator pad extends from the isolator pad recess (e.g., isolator pad recess 506 of FIGS. 5-7) to the retarded side of the first vane, across the gap.

In one example, a hydraulic pressure or other actuating force may be exerted on the locking pin to counteract the biasing force (e.g., spring) urging the pin toward the recess. Moving the locking pin into the locking pin recess may include actuating a solenoid to control a valve to decrease (e.g., discontinue) the hydraulic pressure or other actuating force exerted on the locking pin, thereby allowing dissipation of the hydraulic pressure acting on the locking pin. Therein, a spring, such as the example spring 344 shown in FIG. 3, configured to exert an axial force on the locking pin, may return the locking pin to a locked position in the locking pin recess, when the actuating force exerted on the locking pin is discontinued.

At 812, the method includes maintaining a gap between the first surface of the first vane and the first wall of the housing via a portion of the isolator pad extending between the first surface of the first vane and the first wall of the housing.

The method then proceeds to 814, where the routine includes determining whether a request to unlock the vane rotor has been received by the controller. In one example, a request to unlock the rotor may be received when operating conditions indicate that adjustment (e.g., advancement) of camshaft timing would increase engine performance, such as when the engine is warm and the controller receives a signal indicating the operator has requested an increase in engine torque. In one example, a request to unlock the rotor and advance camshaft timing may be received when the engine temperature or the engine oil temperature is above a predetermined temperature threshold. In another example, a request to unlock the rotor and advance camshaft timing may be received when the engine speed is above a predetermined level. As discussed previously, an unlocked position is the position where the locking pin of the vane of the rotor is retracted from the locking pin recess of the cover plate of the phase control apparatus. This may be known as an active condition, wherein the locking pin extending from a rotor vane is decoupled from a locking pin recess disposed in the cover plate coupled to the housing, allowing the rotor to rotate with respect to the housing as controlled by the inflow of hydraulic oil into respective hydraulic chambers of the housing. If a request to unlock the rotor has not been requested, then the method includes continuing to maintain a gap between the first surface of the first vane and the first wall of the housing via a portion of the isolator pad extending between the first surface of the first vane and the first wall of the housing.

If a request to unlock the rotor is received at 814, then at 816, the method includes moving the locking pin away from and out of the locking pin recess and rotating the rotor into a desired cam position. As previously described, hydraulic pressure or other actuating force may be selectively introduced or drained to exert a force on the locking pin that may counteract the biasing force (e.g., spring) that urges the pin toward the locking pin recess. In one example, moving the locking pin away from and out of the locking pin recess may include actuating a solenoid to increase the opening of a control a valve to permit entrance of hydraulic fluid into the locking pin recess (e.g., cavity) thereby increasing the hydraulic pressure exerted on the locking pin. Therein, the hydraulic pressure exerted on the locking pin, in a direction opposite the biasing force exerted by the locking pin spring, may increase so that it overcomes the spring force, thereby moving the locking pin into the unlocked position by causing it to slide axially along a bore in the housing, in a direction away from the locking pin recess and toward an inner plate of the phase control apparatus. When the locking pin is decoupled from the locking pin recess, the rotor may be rotated as specified by the controller to a desired cam position, as determined by engine operating conditions. The method then ends.

In this way, the isolator pad 401 may serve to dampen the impact between components of the phase control apparatus 300 as it is moved to the locked configuration and may prevent metal-to-metal contact, thereby reducing component wear, as well as reducing issues with NVH such as knocking. Further, this can be accomplished without attempting to tightly control the natural camshaft torque fluctuations and/or the backlash between the locking pin and the locking pin recess, which is costly to manufacture and may degrade with normal wear of system components.

The technical effect of slidably positioning the isolator pad partially within a recess of the housing, where it is held in place by the inner plate and outer plate of the phase control apparatus when assembled, is that complicated and costly methods of attaching the isolator pad can be avoided.

As one embodiment, a system for a phase control apparatus for a camshaft includes a vane rotor positioned within a housing and including a first vane extending from a central hub; a first chamber formed between walls of the housing and the hub, the first vane arranged within the first chamber; and an isolator pad positioned within a recess of a first wall of the walls and between the first wall and a first sidewall of the first vane. In a first example of the system, the vane rotor includes a second vane separated from the first vane and arranged within a second chamber of the housing, the second chamber spaced away from the first chamber, and wherein only the first vane includes a locking pin adapted to lock rotation of the vane rotor within the housing. A second example of the system optionally includes the first example and further includes wherein the first wall includes a planar, first section arranged adjacent to an angled, second section depressed inward, into the housing, from the first section, wherein the first section is positioned closer to the hub than the second section and wherein only the first section includes the recess. A third example of the system optionally includes one or more of the first and second examples, and further includes wherein the isolator pad extends along an entire length of the housing, the length defined in a direction of a rotational axis of the vane rotor, and wherein the isolator pad extends along only a portion of width of the first wall, the width defined between a first inner circumferential wall of the housing arranged proximate an outer circumferential surface of the first vane and a second inner circumferential wall of the housing arranged closer to the hub of the vane rotor than the first inner circumferential wall. A fourth example of the system optionally includes one or more of the first through third examples, and further includes wherein the isolator pad includes a first end positioned entirely within the recess and a second end extending outward from the first end and protruding outward from the first wall. A fifth example of the system optionally includes one or more of the first through fourth examples, and further includes wherein the first end is wider than the second end and wherein the isolator pad is adapted to slide within the recess. A sixth example of the system optionally includes one or more of the first through fifth examples, and further includes an outer plate and an inner plate sandwiching the vane rotor within the housing and adapted to hold the isolator pad within the recess, on either end of the housing. A seventh example of the system optionally includes one or more of the first through sixth examples, and further includes wherein the second end includes a planar surface adapted to have face-sharing contact with a planar surface of the first sidewall when the vane rotor is locked against a cover plate coupled to the housing. An eighth example of the system optionally includes one or more of the first through seventh examples, and further includes wherein the planar surface of the first sidewall is arranged within an indentation that protrudes into the first vane from an outer surface of the first sidewall and wherein the second end of the isolator pad is adapted to extend into the indentation and have face-sharing contact with the planar surface of the first sidewall. A ninth example of the system optionally includes one or more of the first through eighth examples, and further includes wherein when the vane rotor is locked against a cover plate coupled to the housing via a locking pin extending through the first vane, the first sidewall of the first vane and the first wall of the housing are separated from one another via a gap, the isolator pad extending between the first wall and first sidewall, across the gap. A tenth example of the system optionally includes one or more of the first through ninth examples, and further includes wherein the first chamber is formed between the first wall of the walls of the housing, a second wall of the walls of the housing, a first inner circumferential wall of the housing, and the hub, where the first wall is arranged opposite the second wall in a direction of a circumference of the housing, and where the first inner circumferential wall is coupled to each of the first wall and second wall, and wherein only the first wall of the walls includes the recess including the isolator pad. An eleventh example of the system optionally includes one or more of the first through tenth examples, and further includes wherein the vane rotor and the housing are constructed of a metal material and the isolator pad is constructed of a rubber or plastic material.

In another embodiment, a method for operating a variable cam timing (VCT) system includes: in response to a request to lock rotation of a rotor within a housing of a drive wheel of the VCT system: rotating the rotor into a retarded cam position where a first surface of a first vane of the rotor is in face-sharing contact with an isolator pad slidably positioned within a first recess within a first surface of the housing, wherein the first vane is positioned in a first hydraulic chamber of the housing formed, in part, by the first surface of the housing; and moving a locking pin into a locking pin recess disposed in a cover plate coupled to the housing, the locking pin extending from the first vane. In a first example of the method, rotating the rotor into the retarded position includes moving a second vane of the rotor toward a second surface of the housing forming, in part, a second hydraulic chamber that is spaced away from the first hydraulic chamber, and maintaining a gap between the second vane and the second surface, and where the second surface does not include a recess with an isolator pad. A second example of the method optionally includes the first example and further includes holding the isolator pad within the recess with an outer plate coupled to a first, outer surface of the housing and an inner plate coupled to a second, outer surface of the housing and wherein the rotor is positioned within the housing, between the outer plate and inner plate. A third example of the method optionally includes one or more of the first and second examples, and further includes while rotation of the rotor is locked and the rotor is in the retarded cam position, maintaining a gap between the first surface of the first vane and the first surface of the housing via a portion of the isolator pad extending between the first surface of the vane and the first surface of the housing.

In a further embodiment, a system for a variable cam timing system includes: a camshaft including a plurality of cams, each cam of the plurality of cams adapted to actuate a valve of a cylinder; a phase control apparatus coupled to the camshaft and including: a cover plate including a drive wheel; a housing fixed to the drive wheel and positioned proximate to the cover plate at a first end of the housing; a vane rotor including a first vane and positioned within the housing, the first vane positioned within a first hydraulic chamber of the housing formed between a hub of the vane rotor, a first inner circumferential wall of the housing, and first and second sidewalls of the housing, the first and second sidewalls each coupled to the first inner circumferential wall; and an isolator pad positioned within a recess formed within the first sidewall, where the first sidewall is a retarded side of the first hydraulic chamber, and where the first vane is positioned at the retarded side when the camshaft is actuated into a retarded position. In a first example of the system, the vane rotor further includes a second vane positioned within a second hydraulic chamber of the housing, the second hydraulic chamber spaced away from the first hydraulic chamber, and wherein no walls of the second hydraulic chamber include a recess with an isolator pad. A second example of the method optionally includes the first example and further includes wherein the cover plate includes a locking pin recess and further comprising a locking pin positioned within a bore of the first vane and movable into a locked position where the locking pin engages the recess, wherein in the locked position a retarded side of the first vane is in face-sharing contact with the isolator pad and separated from the first sidewall via a gap, the isolator pad extending from the recess to the retarded side of the first vane, across the gap. A third example of the method optionally includes one or more of the first and second examples, and further includes an outer plate coupled between the first end of the housing and the cover plate and an inner plate positioned against an opposite, second end of the housing, wherein the isolator pad extends within the recess between the inner plate and outer plate, and wherein the isolator pad extends only partially across an entire width of the first sidewall, the width defined between the first inner circumferential wall and a second inner circumferential wall of the housing, where the second inner circumferential wall is positioned proximate to the hub.

In another representation, a phase control apparatus for a camshaft, comprises: a vane rotor positioned within a housing and including a first vane and a second vane, each, extending from a central hub; a first chamber formed between walls of the housing and the hub, the first vane arranged within the first chamber; a second chamber formed between walls of the housing and the hub, the second vane arranged within the second chamber; a locking pin arranged within a bore of only the first vane and adapted to lock rotation of the vane rotor relative to the housing; and an isolator pad positioned only within a recess of a first wall of the walls of the first chamber and between the first wall and a first sidewall of the first vane, where the walls of the housing of the second chamber do not include a recess with an isolator pad.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A phase control apparatus for a camshaft, comprising:

a vane rotor positioned within a housing and including a first vane extending from a central hub;

a first chamber formed between walls of the housing and the hub, the first vane arranged within the first chamber; and an isolator pad positioned within a recess of a first wall of the walls and between the first wall and a first sidewall of the first vane;

wherein the vane rotor includes a second vane separated from the first vane and arranged within a second chamber of the housing, the second chamber spaced away from the first chamber, and wherein only the first vane includes a locking pin adapted to lock rotation of the vane rotor within the housing.

2. The phase control apparatus of claim 1, wherein the first wall includes a planar, first section arranged adjacent to an angled, second section depressed inward, into the housing, from the first section, wherein the first section is positioned closer to the central hub than the second section, and wherein only the first section includes the recess.

3. The phase control apparatus of claim 1, wherein the isolator pad extends along an entire length of the housing, the entire length of the housing defined in a direction of a rotational axis of the vane rotor, and wherein the isolator pad extends along only a portion of a width of the first wall, the width defined between a first inner circumferential wall of the housing arranged proximate an outer circumferential surface of the first vane and a second inner circumferential wall of the housing arranged closer to the central hub of the vane rotor than the first inner circumferential wall.

4. The phase control apparatus of claim 1, wherein the isolator pad includes a first end positioned entirely within the recess and a second end extending outward from the first end and protruding outward from the first wall.

5. The phase control apparatus of claim 4, wherein the first end is wider than the second end and wherein the isolator pad is adapted to slide within the recess.

6. The phase control apparatus of claim 5, further comprising an outer plate and an inner plate sandwiching the vane rotor within the housing and adapted to hold the isolator pad within the recess, on either end of the housing.

7. The phase control apparatus of claim 4, wherein the second end includes a planar surface adapted to have face-sharing contact with a planar surface of the first sidewall when the vane rotor is locked against a cover plate coupled to the housing.

8. The phase control apparatus of claim 7, wherein the planar surface of the first sidewall is arranged within an indentation that protrudes into the first vane from an outer surface of the first sidewall and wherein the second end of the isolator pad is adapted to extend into the indentation and have face-sharing contact with the planar surface of the first sidewall.

9. The phase control apparatus of claim 4, wherein, when the vane rotor is locked against a cover plate coupled to the housing via the locking pin extending through the first vane, the first sidewall of the first vane and the first wall of the housing are separated from one another via a gap, the isolator pad extending between the first wall and the first sidewall, across the gap.

10. The phase control apparatus of claim 1, wherein the first chamber is formed between the first wall of the walls of the housing, a second wall of the walls of the housing, a first inner circumferential wall of the housing, and the central hub, where the first wall is arranged opposite the second wall in a direction of a circumference of the housing, and where the first inner circumferential wall is coupled to each of the first wall and the second wall, and wherein only the first wall includes the recess including the isolator pad.

11. The phase control apparatus of claim 1, wherein the vane rotor and the housing are constructed of a metal material and the isolator pad is constructed of a rubber or plastic material.

12. A method for operating a variable cam timing (VCT) system, comprising:

in response to a request to lock rotation of a rotor within a housing of a drive wheel of the VCT system:

rotating the rotor into a retarded cam position where a first surface of a first vane of the rotor is in face-sharing contact with an isolator pad slidably positioned within a first recess within a first surface of the housing, wherein the first vane is positioned in a first hydraulic chamber of the housing formed, in part, by the first surface of the housing; and moving a locking pin into a locking pin recess disposed in a cover plate coupled to the housing, the locking pin extending from the first vane.

13. The method of claim 12, wherein rotating the rotor into the retarded position includes moving a second vane of the rotor toward a second surface of the housing forming, in part, a second hydraulic chamber that is spaced away from the first hydraulic chamber, and maintaining a gap between the second vane and the second surface, and wherein the second surface does not include a recess with an isolator pad.

14. The method of claim 12, further comprising holding the isolator pad within the recess with an outer plate coupled to a first, outer surface of the housing and an inner plate coupled to a second, outer surface of the housing, wherein the rotor is positioned within the housing, between the outer plate and the inner plate.

15. The method of claim 12, further comprising, while rotation of the rotor is locked and the rotor is in the retarded cam position, maintaining a gap between the first surface of the first vane and the first surface of the housing via a portion of the isolator pad extending between the first surface of the vane and the first surface of the housing.

16. A variable cam timing (VCT) system, comprising:

a camshaft including a plurality of cams, each cam of the plurality of cams adapted to actuate a valve of a cylinder;

a phase control apparatus coupled to the camshaft and including:

a cover plate including a drive wheel;

a housing fixed to the drive wheel and positioned proximate to the cover plate at a first end of the housing;

a vane rotor including a first vane and positioned within the housing, the first vane positioned within a first hydraulic chamber of the housing formed between a hub of the vane rotor, a first inner circumferential wall of the housing, and first and second sidewalls of the housing, the first and second sidewalls each coupled to the first inner circumferential wall; and an isolator pad positioned within a recess formed within the first sidewall, where the first sidewall is a retarded side of the first hydraulic chamber, and where the first vane is positioned at the retarded side when the camshaft is actuated into a retarded position.

17. The VCT system of claim 16, wherein the vane rotor further includes a second vane positioned within a second hydraulic chamber of the housing, the second hydraulic chamber spaced away from the first hydraulic chamber, and wherein no walls of the second hydraulic chamber include a recess with an isolator pad.

18. The VCT system of claim 16, wherein the cover plate includes a locking pin recess and further comprising a locking pin positioned within a bore of the first vane and movable into a locked position where the locking pin engages the locking pin recess, and wherein, in the locked position, a retarded side of the first vane is in face-sharing contact with the isolator pad and separated from the first sidewall via a gap, the isolator pad extending from the recess to the retarded side of the first vane, across the gap.

19. The VCT system of claim 16, further comprising an outer plate coupled between the first end of the housing and the cover plate and an inner plate positioned against an opposite, second end of the housing, wherein the isolator pad extends within the recess between the inner plate and the outer plate, and wherein the isolator pad extends only partially across an entire width of the first sidewall, the width defined between the first inner circumferential wall and a second inner circumferential wall of the housing, where the second inner circumferential wall is positioned proximate to the hub.

* * * * *